US010276129B2

(12) United States Patent
Lin

(10) Patent No.: US 10,276,129 B2
(45) **Date of Patent: *Apr. 30, 2019**

(54) IMAGE ADJUSTING METHOD CAPABLE OF EXECUTING OPTIMAL ADJUSTMENT ACCORDING TO ENVIRONMENTAL VARIATION AND RELATED DISPLAY

(71) Applicant: BENQ CORPORATION, Taipei (TW)

(72) Inventor: Hsin-Nan Lin, Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/379,492

(22) Filed: Dec. 15, 2016

(65) Prior Publication Data

US 2017/0200430 A1 Jul. 13, 2017

(30) Foreign Application Priority Data

Jan. 8, 2016 (TW) ..... 105100467 A

(51) Int. Cl.

| | |
|---|---|
| ***G09G 5/02*** | (2006.01) |
| ***G09G 5/10*** | (2006.01) |
| ***G09G 3/20*** | (2006.01) |
| ***G09G 3/34*** | (2006.01) |

(52) U.S. Cl.

CPC ..... *G09G 5/10* (2013.01); *G09G 3/20* (2013.01); *G09G 3/2007* (2013.01); *G09G 3/3406* (2013.01); *G09G 2320/0285* (2013.01); *G09G 2320/0646* (2013.01); *G09G 2360/144* (2013.01); *G09G 2360/16* (2013.01)

(58) Field of Classification Search

CPC ..... H04N 1/4051; G06T 5/40; G06T 9/20; G09G 3/2051; G09G 5/14

USPC ..... 345/599

See application file for complete search history.

(56) References Cited

U.S. PATENT DOCUMENTS

| | | | | |
|---|---|---|---|---|
| 6,579,239 | B1 * | 6/2003 | Avinash | G01S 7/52034 600/443 |
| 8,237,688 | B2 * | 8/2012 | Huang | G06T 5/009 345/102 |
| 2010/0053222 | A1 | 3/2010 | Kerofsky | |
| 2010/0265228 | A1 * | 10/2010 | Kimura | G09G 3/3233 345/207 |

FOREIGN PATENT DOCUMENTS

EP 1 927 977 A2 6/2008

OTHER PUBLICATIONS

Wang, Yao,. EL5123—Image Processing Contrast Enhancement. Polytechnic University, Brooklyn, NY 11201, Jan. 23, 2013 [online]. Retrieved from the Internet: <https://web.archive.org/web/20130123162640/http://eeweb.poly.edu/~yao/EL5123/lecture3_contrast_enhancement.pdf>.*

(Continued)

*Primary Examiner* — Gordon G Liu

(57) ABSTRACT

An image adjusting method capable of executing optimal adjustment according to environmental variation is applied to a related display. The image adjusting method includes generating a gray level histogram of an image, calculating a pixel amount of a boundary zone on the gray level histogram, comparing the pixel amount with a threshold, and utilizing an amending function to adjust the pixel intensity of the boundary zone while the pixel amount is greater than the threshold.

22 Claims, 4 Drawing Sheets

(56) References Cited

OTHER PUBLICATIONS

Shapiro, Chapter 5 Filtering and Enhancing Images, Feb. 25, 2014, [online], [retrieved on Mar. 5, 2018]. Retrieved from the Internet <URL: https://courses.cs.washington.edu/courses/cse576/book/ch5.pdf>.*

* cited by examiner

IMAGE ADJUSTING METHOD CAPABLE OF EXECUTING OPTIMAL ADJUSTMENT ACCORDING TO ENVIRONMENTAL VARIATION AND RELATED DISPLAY

BACKGROUND OF THE INVENTION

1. Field of the Invention

The present invention relates to an image adjusting method and a related display, and more particularly, to an image adjusting method capable of executing optimal adjustment according to environmental variation and a related display.

2. Description of the Prior Art

Image intensity of the display can be adjusted in accordance with environmental variation to provide special visual experience. For example, while the display kept at the first degree illumination is put in a bright environment, the user can comfortably watch the image with the first degree illumination; while the display kept at the first degree illumination is moved to a bark environment, the image displayed by the first degree illumination is harsh to the user's eyes. For overcoming the drawback, a display capable of automatically adjusting its backlight is designed to utilize an optical detector to acquire the surrounding illumination, and the backlight intensity of the conventional display is adjusted according to variation of the surrounding illumination. However, the conventional backlight adjustment technique changes intensity of total pixels on the image, the specific high-intensity pattern or low-intensity on the image may be difficult recognized and the related image cannot provide satisfied quality.

SUMMARY OF THE INVENTION

The present invention provides an image adjusting method and a related display capable of executing optimal adjustment according to environmental variation for solving above drawbacks.

According to the claimed invention, an image adjusting method includes steps of generating a gray level histogram of an image, calculating a pixel amount of a boundary zone on the gray level histogram, comparing the pixel amount with a threshold, and utilizing an amending function to adjust each pixel intensity of the boundary zone while the pixel amount is greater than the threshold.

According to the claimed invention, a display includes a panel unit and an operating processor. The panel unit is adapted to display an image. The operating processor is electrically connected to the panel unit. The operating processor is adapted to generate a gray level histogram of the image, calculate a pixel amount of a boundary zone on the gray level histogram, compare the pixel amount with a threshold, and utilize an amending function to adjust the pixel intensity of the boundary zone while the pixel amount is greater than the threshold.

The image adjusting method and the related display of the present invention can execute optimal image adjustment in accordance with environmental variation, and the intensity of the image can be automatically adjusted to be comfortably watched in accordance with the surrounding environment. For a start, the image adjusting method adjusts the backlight intensity of the image according to the detection result of the surrounding illumination via the optical detector, however the foresaid backlight intensity adjustment may result in pattern distortion of the bright zone or the dark zone on the image; therefore, the image adjusting method further calculates the pixel amount of the boundary zone on the gray level histogram of the image, and then determines whether the pattern distortion of the bright zone or the dark zone is within the tolerant extent. As the said pattern distortion does not exceed the tolerant extent, the image adjusting method can directly adjust the pixel intensity of the boundary zone according to the predetermined parameter, or analyzes the pixel amount of the boundary zone and accordingly choose the suitable function from the plurality of amending functions for the pixel intensity adjustment. The display of the present invention not only can automatically adjust the backlight intensity of the image according to the surrounding circumstances, but also can choose the suitable amending function in accordance with color adjustment (such as levels of saturation, hue and sharpness) and pixel statistics of the specific zones for self-adaptive image parameter adjustment.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
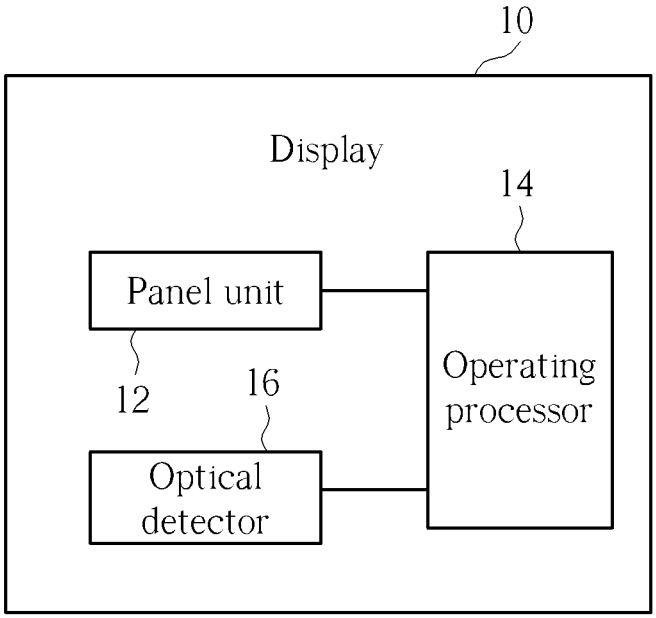
FIG. 1 is a functional block diagram of a display according to an embodiment of the present invention.

Please refer to FIG. 1. FIG. 1 is a functional block diagram of a display 10 according to an embodiment of the present invention. The display 10 includes a panel unit 12, an operating processor 14 and an optical detector 16. The panel unit 12 is utilized to display an image. The optical detector 16 is utilized to detect surrounding illumination of the display 10. The operating processor 14 is electrically connected to the panel unit 12 and the optical detector 16. The display 10 utilizes the optical detector 16 to acquire the surrounding illumination, the operating processor 14 adjusts backlight intensity of the panel unit 12 in accordance with a detection result of the surrounding illumination, and a plurality of amending functions is applied to adjust intensity of several zones on the panel unit 12, so that the user can watch the image displayed on the panel unit 12 in different environments comfortably. The said amending functions are generated by an amending function generating unit of the operating processor 14.

Figure 2:
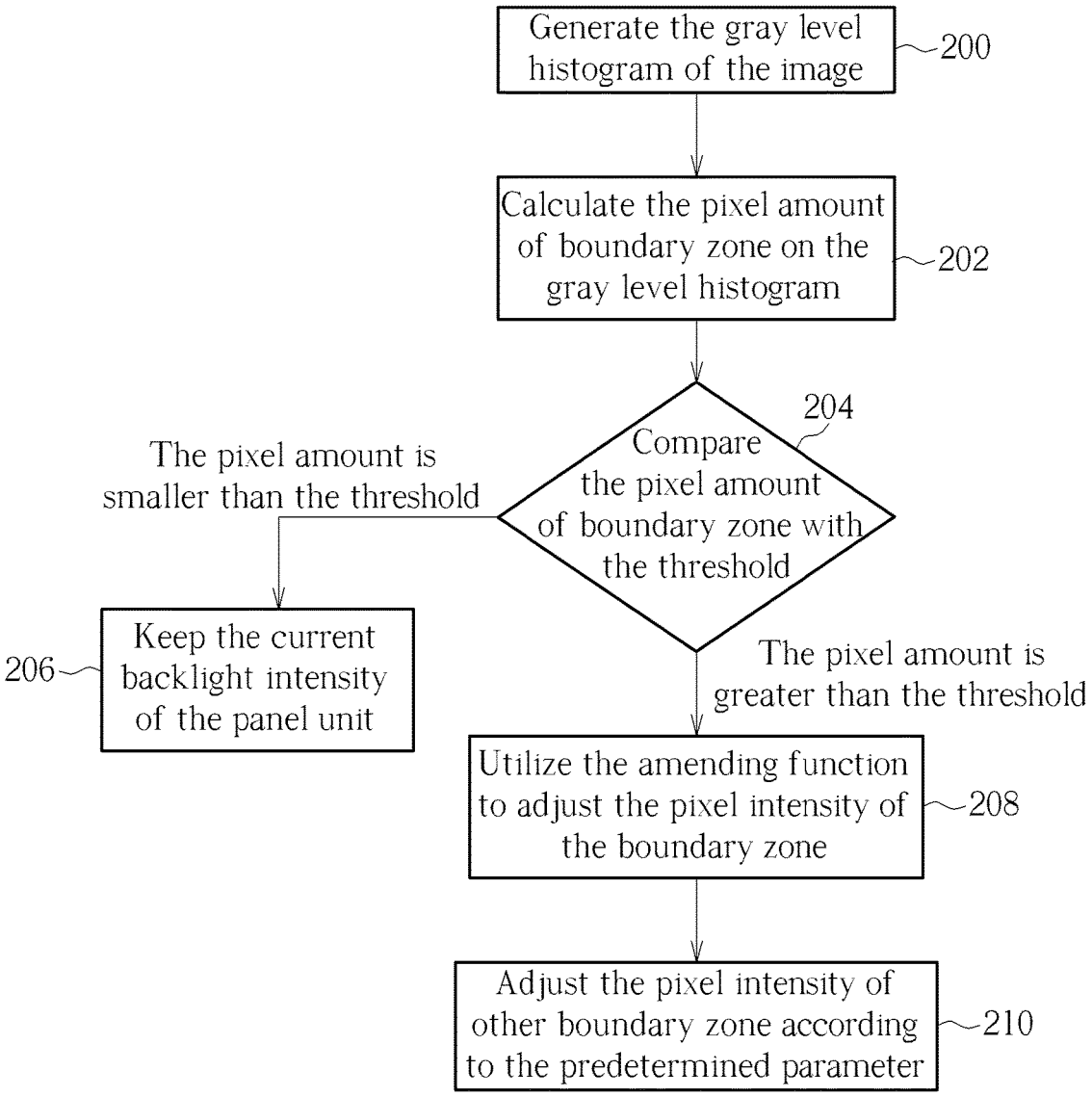
FIG. 2 is a flow chart of an image adjusting method according to the embodiment of the present invention.
Figure 3:
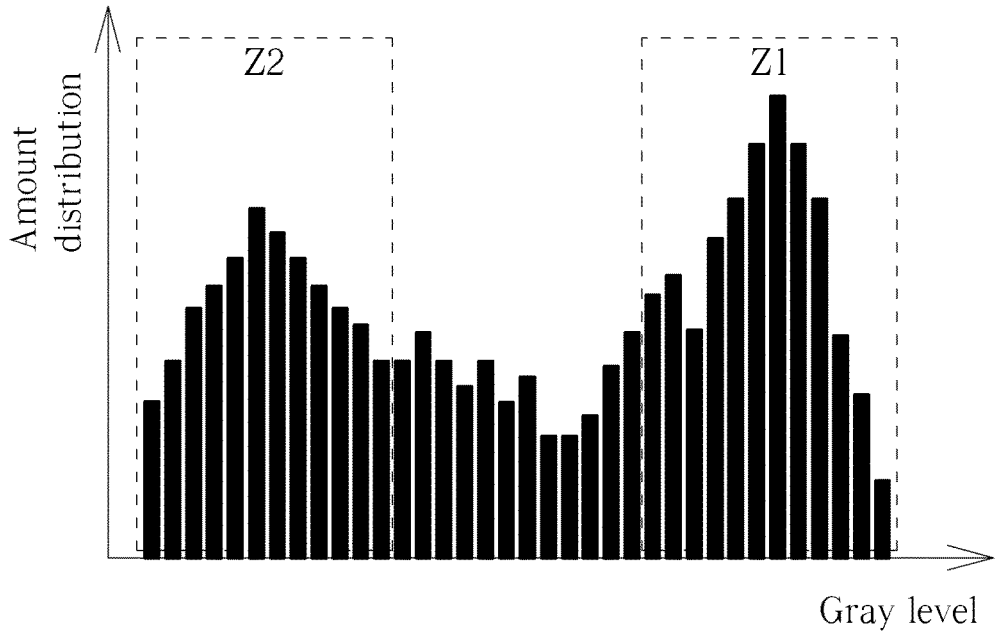
FIG. 3 is a gray level histogram of an image displayed on a panel unit according to the embodiment of the present invention.
Figure 4:
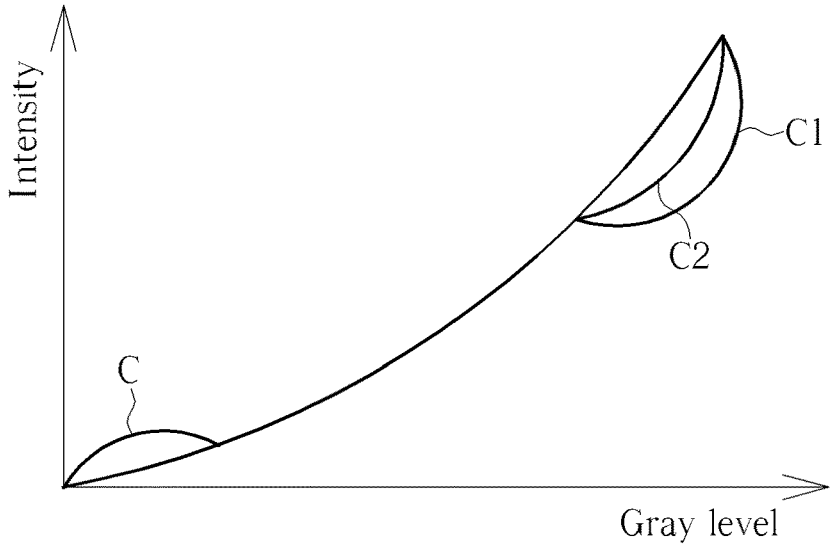
FIG. 4 to FIG. 6 respectively are curve diagrams of image pixel intensity varied in different environments according to the embodiment of the present invention.
Figure 5:
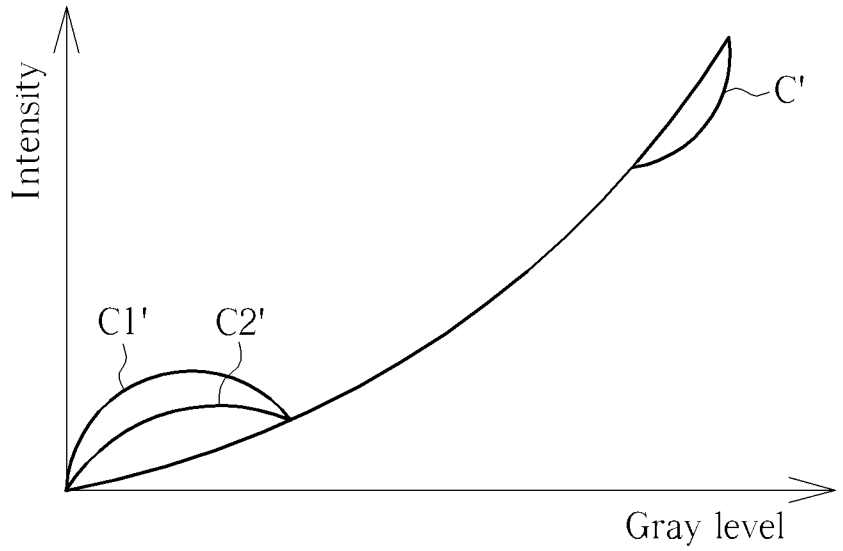
Figure 6:
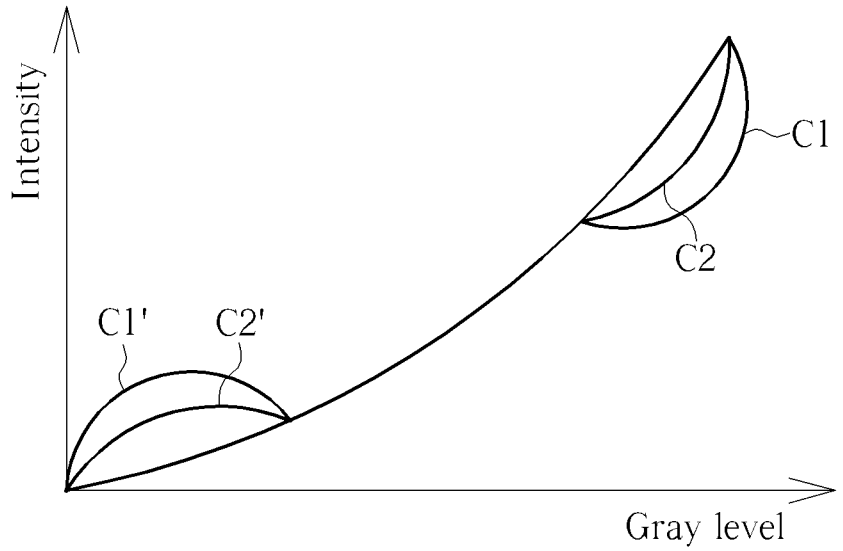

Please refer to FIG. 2 to FIG. 6. FIG. 2 is a flow chart of an image adjusting method according to the embodiment of the present invention. FIG. 3 is a gray level histogram of the image displayed on the panel unit 12 according to the embodiment of the present invention. FIG. 4 to FIG. 6 respectively are curve diagrams of image pixel intensity varied in different environments according to the embodiment of the present invention. The image adjusting method illustrated in FIG. 2 is suitable for the display 10 shown in FIG. 1. In the said image adjusting method, steps 200 and 202 are executed that a gray level distribution counting unit of the operating processor 14 generates a gray level histogram of the image, and then calculates a pixel amount of at least one boundary zone on the gray level histogram. It should be mentioned that the operating processor 14 can divide the gray level histogram into a plurality of zones sequentially in accordance with distribution of gray levels. The image adjusting method of the present invention preferably utilizes two opposite boundary zones on the gray level histogram, such as a first boundary zone Z1 or a second boundary zone Z2, however an actual application of the boundary zone is not limited to the above-mentioned embodiment.

The first boundary zone Z1 and the second boundary zone Z2 can conform to design demand of the present invention since the said boundary zone is adjacent to a border of the gray level histogram, the first boundary zone Z1 or the second boundary zone Z2 may be not actually cover the border of the gray level histogram. For example, a pixel value of the first boundary zone Z1 can be ranged between 230~255 (which covers the border of the gray level histogram), or ranged between 230~250 (which does not cover the border of the gray level histogram); a pixel value of the second boundary zone Z2 can be ranged between 0~32 (which covers the border of the gray level histogram), or ranged between 5~32 (which does not cover the border of the gray level histogram). Ranges of the first boundary zone Z1 and the second boundary zone Z2 are not limited to the above-mentioned values, which depend on design demand.

In the image adjusting method, step 204 is executed to compare the pixel amount of one of the plurality of boundary zones (such as the first boundary zone Z1) with a threshold. Step 206 is executed to keep the current backlight intensity of the panel unit 12 while the pixel amount is smaller than the threshold, which means the intensity of several zones on the panel unit 12 is invariable. Further, step 208 is executed that an intensity adjusting unit of the operating processor 14 utilizes the amending function to adjust the pixel intensity of the boundary zone (such as the first boundary zone Z1) while the pixel amount is greater than the threshold, and a pixel intensity of a middle zone on the gray level histogram is not varied by the amending function. The image adjusting method of the present invention may be designed as including a plurality of amending functions, and step 208 can optionally utilizes one of the plurality of amending functions to adjust the intensity of several zones in accordance with the pixel amount of the said boundary zone (such like the first boundary zone Z1). Final, step 210 is executed that the operating processor 14 adjusts a pixel intensity of other boundary zone (such as the second boundary zone Z2) from the plurality of boundary zones on the several zones according to the predetermined parameter; the foresaid step may directly adjust the pixel intensity, instead of adjusting the pixel intensity by the selected amending function in accordance with a comparison of the pixel amount of the other boundary zone to the threshold.

As shown in FIG. 2 and FIG. 4, the first boundary zone Z1 is a high-intensity zone on the gray level histogram, and the second boundary zone Z2 is a low-intensity zone on the gray level histogram. The image adjusting method can choose the suitable amending function from the plurality of amending functions C1 and C2 to decrease the pixel intensity of the high-intensity zone while the pixel amount of the first boundary zone Z1 is greater than the threshold; in the meantime, the image adjusting method further can increase the pixel intensity of the second boundary zone Z2 in accordance with the predetermined parameter C (which can be a kind of amending function), so that the high-intensity zone and the low-intensity zone on the image can be adaptively adjusted according to the pixel amount, and the user can comfortably watch the brightness-adjusted image displayed on the display 10.

As shown in FIG. 2 and FIG. 5, the first boundary zone Z1 is a high-intensity zone on the gray level histogram, and the second boundary zone Z2 is a low-intensity zone on the gray level histogram. The image adjusting method can choose the suitable amending function from the plurality of amending functions C1' and C2' to increase the pixel intensity of the low-intensity zone while the pixel amount of the second boundary zone Z2 is greater than the threshold. Besides, the image adjusting method can optionally decrease the pixel intensity of the first boundary zone Z1 in accordance with the predetermined parameter C', which means the high-intensity zone and the low-intensity zone on the image can be adaptively adjusted according to distribution statistics of the pixel amount.

As shown in FIG. 2 and FIG. 6, the first boundary zone Z1 is the high-intensity zone on the gray level histogram, and the second boundary zone Z2 is the low-intensity zone on the gray level histogram. The image adjusting method can choose the suitable amending function from the plurality of amending functions C1 and C2 to decrease the pixel intensity of the high-intensity zone while the pixel amount of the first boundary zone Z1 is greater than the threshold; the image adjusting method further can choose the suitable amending function from the plurality of amending functions C1' and C2' to increase the pixel intensity of the second boundary zone Z2. The above-mentioned embodiments teach that the image adjusting method of the present invention can adjust the pixel intensity of the high-intensity zone and/or the low-intensity zone in accordance with the pixel amount statistics of the gray level histogram, or can optionally adjust the pixel intensity of any zones located between the high-intensity zone and the low-intensity zone on the image. Variation of pixel intensity adjustment is not limited to the above-mentioned embodiments, which depends on design demand.

In conclusion, the image adjusting method and the related display of the present invention can execute optimal image adjustment in accordance with environmental variation, and the intensity of the image can be automatically adjusted to be comfortably watched in accordance with the surrounding environment. For a start, the image adjusting method adjusts the backlight intensity of the image according to the detection result of the surrounding illumination via the optical detector, however the foresaid backlight intensity adjustment may result in pattern distortion of the bright zone or the dark zone on the image; therefore, the image adjusting method further calculates the pixel amount of the boundary zone on the gray level histogram of the image, and then determines whether the pattern distortion of the bright zone or the dark zone is within the tolerant extent. As the said pattern distortion does not exceed the tolerant extent, the image adjusting method can directly adjust the pixel intensity of the boundary zone according to the predetermined parameter, or analyzes the pixel amount of the boundary zone and accordingly choose the suitable function from the plurality of amending functions for the pixel intensity adjustment. Comparing to the prior art, the display of the present invention not only can automatically adjust the backlight intensity of the image according to the surrounding circumstances, but also can choose the suitable amending function in accordance with color adjustment (such as levels of saturation, hue and sharpness) and pixel statistics of the specific zones for self-adaptive image parameter adjustment.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image adjusting method utilizing a display having a panel unit and an operating processor, the image adjusting method comprising:

the operating processor increasing backlight intensity of the panel unit in accordance with a detection result of surrounding illumination;

the operating processor generating a gray level histogram of an image displayed on the panel unit;

the operating processor calculating a total pixel amount of a fixed-sized high-intensity boundary zone comprising a fixed plurality of distinct grayscale levels on the gray level histogram;

the operating processor comparing the total pixel amount with a threshold; and the operating processor utilizing an amending function to adjust each pixel intensity of the boundary zone to reduce image contrast while the total pixel amount is greater than the threshold.

2. The image adjusting method of claim 1, wherein pixel intensity values outside of the boundary zone are not adjusted.

3. The image adjusting method of claim 1, wherein the image adjusting method comprises a plurality of amending functions, the pixel intensity of the boundary zone is optionally adjusted by one of the plurality of amending functions in accordance with the pixel amount.

4. The image adjusting method of claim 1, further comprising:

the operating processor adjusting a pixel intensity of other boundary zone on the gray level histogram by a predetermined parameter, wherein the boundary zone and the other boundary zone are two opposite zones on the gray level histogram.

5. The image adjusting method of claim 4, wherein the boundary zone is a high-intensity zone on the gray level histogram, and the amending function is utilized to decrease the pixel intensity of the high-intensity zone.

6. The image adjusting method of claim 5, wherein the other boundary zone is a low-intensity zone on the gray level histogram, and the pixel intensity of the low-intensity zone is increased according to the predetermined parameter.

7. The image adjusting method of claim 4, wherein the boundary zone is a low-intensity zone on the gray level histogram, and the amending function is utilized to increase the pixel intensity of the low-intensity zone.

8. The image adjusting method of claim 1, wherein a pixel intensity value of the boundary zone includes all pixel intensity values between 230 and 255 or includes all pixel intensity values between 230 and 250.

9. The image adjusting method of claim 1, further comprising:

the operating processor utilizing an optical detector of the display to detect surrounding illumination; and the operating processor adjusting intensity of the image in accordance with the detection result of the surrounding illumination.

10. The image adjusting method of claim 1, wherein a pixel intensity of a middle zone on the gray level histogram is not varied by the amending function.

11. A display, comprising:

a panel unit adapted to display an image; and an operating processor electrically connected to the panel unit, the operating processor increasing backlight intensity of the panel unit in accordance with a detection result of surrounding illumination, the operating processor generating a gray level histogram of the image, calculating a pixel amount of a fixed-sized high-intensity boundary zone on the gray level histogram, wherein a pixel intensity value of the boundary zone includes all pixel intensity values between 230 and 255 or includes all pixel intensity values between 230 and 250, comparing the pixel amount with a threshold, and utilizing an amending function to adjust each pixel intensity of the boundary zone to reduce image contrast while the pixel amount is greater than the threshold.

12. The display of claim 11, wherein pixel intensity values outside of the boundary zone are not adjusted.

13. The display of claim 11, wherein a plurality of amending functions is stored inside the operating processor, and the pixel intensity of the boundary zone is adjusted optionally by one of the plurality of amending functions in accordance with the pixel amount.

14. The display of claim 11, further comprising:

an optical detector electrically connected to the operating processor and adapted to detect surrounding illumination, the operating processor being able to adjust backlight intensity of the panel unit in accordance with the detection result of the surrounding illumination.

15. The display of claim 11, wherein a pixel intensity of a middle zone on the gray level histogram is not varied by the amending function.

16. The display of claim 11, wherein the operating processor is adapted to adjust a pixel intensity of other boundary zone on the gray level histogram by a predetermined parameter, and the boundary zone and the other boundary zone are two opposite zones on the gray level histogram.

17. The display of claim 16, wherein the boundary zone is a high-intensity zone on the gray level histogram, and the amending function is utilized to decrease the pixel intensity of the high-intensity zone.

18. The display of claim 17, wherein the other boundary zone is a low-intensity zone on the gray level histogram, and the pixel intensity of the low-intensity zone is increased according to the predetermined parameter.

19. The display of claim 16, wherein the boundary zone is a low-intensity zone on the gray level histogram, and the amending function is utilized to increase the pixel intensity of the low-intensity zone.

20. An image adjusting method utilizing a display having a panel unit and an operating processor, the image adjusting method comprising:

the operating processor determining a fixed-sized high-intensity boundary zone on the gray level histogram, the fixed-sized high-intensity boundary zone including a fixed plurality of distinct grayscale levels;

the operating processor adjusting backlight intensity of the panel unit in accordance with a detection result of surrounding illumination;

the operating processor generating a gray level histogram of an image displayed on the panel unit; and the operating processor utilizing an amending function to adjust each pixel intensity value of the fixed-sized boundary zone and not adjust pixel intensity values outside of the fixed-sized boundary zone to reduce image contrast.

21. The image adjusting method of claim 20, wherein pixel intensity values outside of the fixed-sized high-intensity boundary zone are not adjusted.

22. The image adjusting method of claim 20, wherein a pixel intensity value of the fixed-sized high-intensity boundary zone includes all pixel intensity values between 230 and 255 or includes all pixel intensity values between 230 and 250.

* * * * *